US005821473A

United States Patent [19]

Takahashi

[11] Patent Number: 5,821,473

[45] Date of Patent: Oct. 13, 1998

[54] SILENCER AND A METHOD FOR FORMING AND ATTACHING A SILENCER TO A BLOWER PIPE

[75] Inventor: Kazunori Takahashi, Kawagoe, Japan

[73] Assignee: Kioritz Corporation, Tokyo, Japan

[21] Appl. No.: 885,833

[22] Filed: Jun. 30, 1997

[30] Foreign Application Priority Data

Jul. 1, 1996 [JP] Japan ..... 8-170797

[51] Int. Cl.[6] ..... E04F 17/04

[52] U.S. Cl. ..... 181/224; 181/252

[58] Field of Search ..... 181/224, 225, 181/230, 200, 202, 204, 205, 211, 227, 228, 252, 256; 415/119; 29/890.08

[56] References Cited

U.S. PATENT DOCUMENTS

| | | | |
|---|---|---|---|
| 4,421,202 | 12/1983 | Hoy | 181/252 |
| 4,508,486 | 4/1985 | Tinker | 415/119 |
| 5,479,706 | 1/1996 | Tamano et al. | 29/890.08 |
| 5,718,045 | 2/1998 | Tsukahara et al. | 29/890.08 |

FOREIGN PATENT DOCUMENTS

| | | |
|---|---|---|
| 5-14000 | 4/1993 | Japan . |
| 8-102664 | 4/1996 | Japan . |

*Primary Examiner*—Khanh Dang
*Attorney, Agent, or Firm*—Thelen Reid & Priest, L.L.P.

[57] ABSTRACT

A method of forming and attaching a silencer to a blower pipe involves a silencer that has an inner pipe with many silencer holes and a sound absorption material extending longitudinally around its outer periphery. The blower pipe may be connected to a blower so that a high speed air stream passe through an interior of the inner pipe. The method has the steps of forming the inner pipe by resilient deformation of a flexible member (such as a pair of thin plates or a helically-formed flexible strip) that has a stress-free length preventing it from inserted into the blower pipe without first being deformed. Then, the resiliently-deformed flexible member is introduced into the blower pipe, and the silencer is attached to the blower pipe using a resilient restoring force that was caused by the resilient deformation.

16 Claims, 6 Drawing Sheets

SILENCER AND A METHOD FOR FORMING AND ATTACHING A SILENCER TO A BLOWER PIPE

TECHNICAL FIELD

The present invention relates to a silencer and a method of forming and attaching a silencer to a blower pipe, and in particular, to a method of easily forming and attaching a silencer to a blower pipe without using rivets, etc.

BACKGROUND OF THE INVENTION

In order to reduce the noise caused by a high speed air stream when a power blower is used, a blower pipe with a silencer is already proposed, for instance, as disclosed in Japanese Utility Model Publication No. HEI 5-14000 and Japanese Patent Application No. HEI 8-102664.

This power blower comprises an internal combustion engine such as a compact air-cooled two-stroke gasoline engine, and a blower fan which is rotated by the internal combustion engine, so that the high speed air stream generated by a blower fan is passed through a blower pipe and blown out from its tip end, whereby cleaning up work such as collecting fallen leaves, dust, etc. is performed by utilizing the high speed air stream.

When the power blower is used, noise is generated due to various reasons, such as the sound of the engine, the rotating sound of the blower fan, etc. In order to reduce the particular noise caused by the high speed air stream, a silencer is provided on the end portion of the blower pipe.

The silencer comprises an inner pipe into which many silencer holes are formed, and a sound absorption material which extends a certain length in the longitudinal direction of the inner pipe and extends around the outer periphery of the inner pipe, so that by interposing the sound absorption material between the blower pipe and the inner pipe, the noise can be reduced when the high speed air stream passes through the interior of the inner pipe.

In particular, the power blower disclosed in Japanese Patent Application No. HEI 8-102664 includes the blower pipe which has a substantially constant diameter for ease of handling in use thereof.

However, the attachment of the silencer comprising such a sound absorption material and an inner pipe to the blower pipe can be troublesome because it usually has to be attached by means of fittings such as bolts, rivets, etc., and which attachment requires many manhours to accomplish because many parts of the silencer have to be clamped by the fittings, so that, in general, the attachment of the silencer to the blower pipe can be burdensome. In addition, it takes a great deal of time to service or replace the silencer due to damage or wear thereto.

SUMMARY OF THE INVENTION

Therefore, taking the above problem into account, the object of the present invention is to provide a method of easily and simply forming and attaching the silencer to the blower pipe.

The present invention provides solutions to the above problem by providing a method of forming and attaching a silencer to a blower pipe, in which the silencer has an inner pipe with plural silencer holes and a sound absorption material extending longitudinally around its outer periphery, and in which the blower pipe is adapted to be connected to a blower so that a high-speed air stream passes through an interior of the inner pipe, the method comprising: forming the inner pipe by resilient deformation of a flexible member that has a stress-free length preventing it from being inserted into an interior of the blower pipe; introducing the resiliently-deformed flexible member into the interior of the blower pipe; and attaching the silencer to the blower pipe using a resilient restoring force caused by the resilient deformation.

It is preferable that the blower pipe has a longitudinally-extending enlarged-diameter portion forming an annular cavity, and wherein the method includes: fitting the sound absorption material into the annular cavity.

It is also preferable that the flexible member is a thin plate and the step of forming the inner pipe includes: gradually deforming the thin plate along an inner surface of the enlarged-diameter portion while introducing the thin plate into the blower pipe.

In a preferred aspect of the present invention, the thin plate has opposing edges with respective collars having respective inner surfaces that retain the sound absorption material before the thin plate is introduced into the blower pipe.

In a further preferred aspect of the present invention, the inner pipe includes first and second thin plates having respective sets of collars, and the forming and introducing steps include: resiliently deforming the first and second thin plates into a convex configuration; and introducing the resiliently-deformed first and second thin plates into the blower pipe so that back surfaces of the collars of the first thin plate abut against corresponding back surfaces of the collars of the second thin plate.

In a still further preferred aspect of the present invention, the deforming step includes: deforming the thin plate to have a cross section that is bent substantially uniformly in its longitudinal direction.

In a still further preferred aspect of the present invention, the flexible member includes a helically-formed flexible strip, and the introducing step includes: pulling the helically-formed flexible strip in its longitudinal direction to reduce its diameter while introducing it into the interior of the blower pipe.

According to a method of forming and attaching a silencer to a blower pipe in the present invention, by resiliently deforming a flexible member including such a stress-free length that otherwise it could not be introduced into the interior of the blower pipe as it is, and by utilizing a restoring force generated by such a resilient deformation, the flexible member in the form of an inner pipe is pressed against a sound absorption material which extends a certain length in the longitudinal direction of the inner pipe and extends around the outer periphery of the inner pipe, whereby the sound absorption material is pressed against the inner surface of the blower pipe by the flexible member, and as a result, the silencer can be attached to the blower pipe without using fittings such as bolts, rivets, etc.

Under this condition, a high speed air stream from the power blower can be guided to the blower pipe which is connected to the blower, in which blower pipe the noise generated when the high speed air stream passes through the inner pipe can be reduced due to the inner pipe being provided with many silencer holes and a sound absorption material which extends therearound.

The above and other objects of the present invention can also be accomplished by a silencer for use in an interior of a blower pipe through which a high speed air stream passes, the silencer comprising: an inner pipe, inserted into the interior of the blower pipe, the inner pipe including a flexible member that has a stress-free length preventing it from being inserted into the interior of the blower pipe without first being deformed, but which attaches the silencer to the interior of the blower pipe by a resilient restoring force that is caused by a resilient deformation that allowed the inner pipe to be inserted into the interior of the blower pipe, the inner pipe having plural holes; and a sound absorption material extending longitudinally around an outer periphery of the inner pipe.

BRIEF DESCRIPTION OF THE DRAWINGS

The above and other objects and advantages of the present invention will become apparent from the following description when read in conjunction with the accompanying drawings wherein.

DETAILED DESCRIPTION OF THE PREFERRED EMBODIMENTS

The preferred embodiments will be hereinafter described with reference to the accompanying drawings.

First Embodiment (FIGS. 1 to 4)

Figure 1:
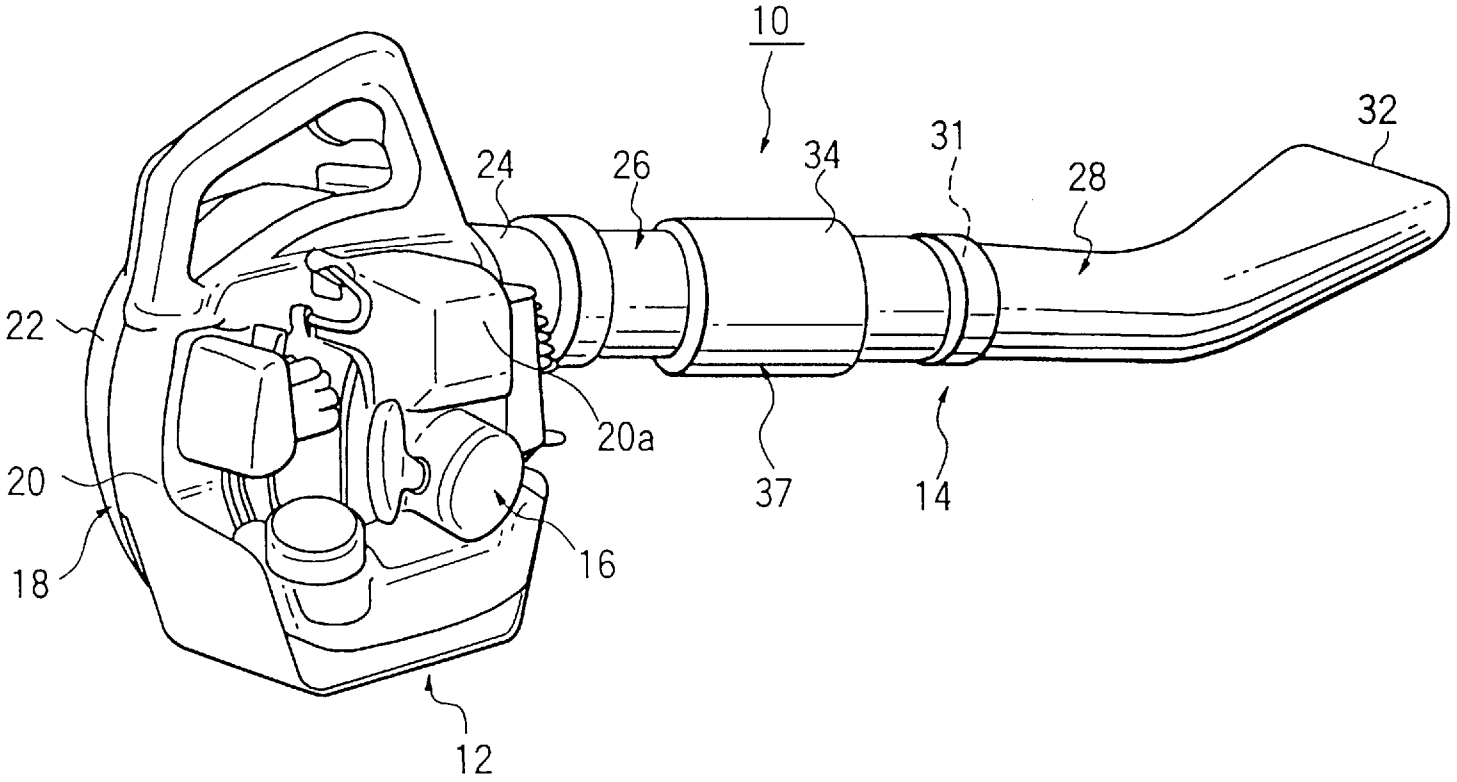
FIG. 1 is a diagrammatic perspective view of a power blower equipped with a blower pipe equipped with a blower pipe according to first and second embodiments of the present invention.

A power blower generally indicated by reference numeral 10 in FIG. 1 is an example of a type of a power blower which an operator holds by one hand and which comprises a main body 12 and a blower pipe portion 14. An internal combustion engine 16 such as a compact air-cooled two-stroke gasoline engine is disposed on one side of the main body 12 and a blower fan ( not shown) is disposed on the other opposed side thereof, so that the blower fan is connected to be rotated by the internal combustion engine 16.

The main body 12 is covered with a cover 18 which includes a right half portion 20 including a cylinder cover 20*a* covering a cylinder portion of the internal combustion engine 16, and a left half portion 22 including an air inlet (not shown) for introducing air from the exterior into the blower fan. An air spout tube portion 24 is formed by joining the cover portions 20,22 together.

Figure 2:
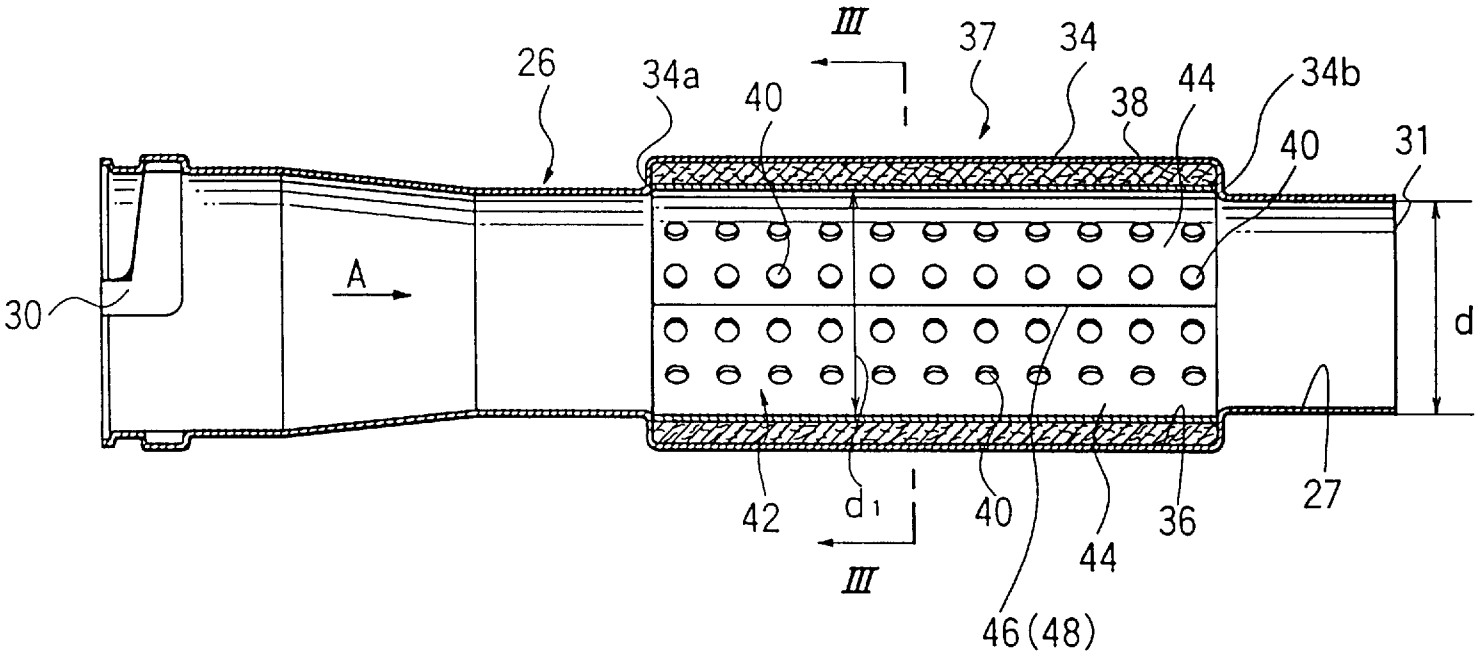
FIG. 2 is a diagrammatic longitudinal sectional view of a portion of the blower pipe according to the first embodiment of the present invention.

The blower pipe portion 14 comprises a blower pipe 26 with a silencer 37 and a blower pipe 28 with a flat blow off spout 32. When the power blower is used, an upstream end opening of the blower pipe 26 is fitted onto the air spout tube portion 24 via L-shaped groove 30 (See FIG. 2), while on the other hand, a downstream end opening 31 of the blower pipe 26 is fitted into an upstream end opening of the blower pipe 28, and as a result, the high speed air stream, which is delivered in a pressurized manner to the air spout tube portion 24 in a direction indicated by an arrow A in FIG. 2, is blown out via the blower pipe portion 14 from the flat blow off spout 32 at the downstream end of the blower pipe 28. The blown out air stream enables fallen leaves, etc. to be collected. The blower pipe 26 includes an enlarged diameter portion 34 which extends a certain length in the longitudinal direction. As shown in FIG. 2, sound absorption material 38, which will be described below, is adapted to be fitted into an annular cavity 36, which is formed inside the enlarged diameter portion 34.

Figure 3:
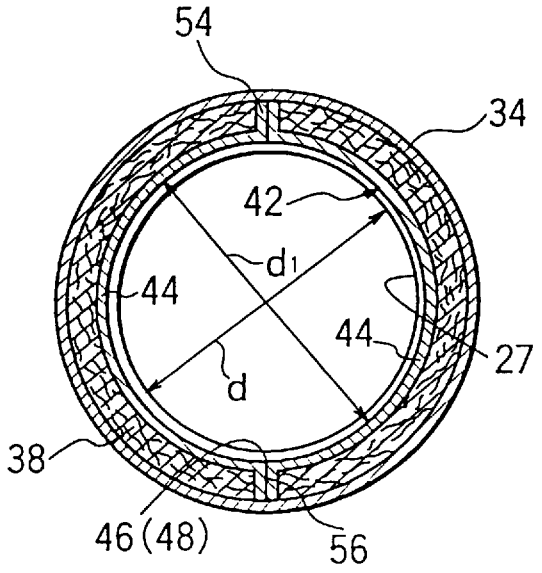
FIG. 3 is a cross sectional view taken along a line III—III of the FIG. 2.
Figure 4A:
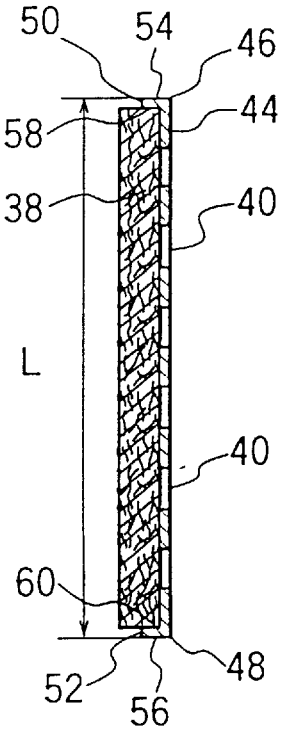
FIGS. 4(*a*) and 4(*b*) are cross sectional views of a silencer before and after its deformation, respectively, showing a method of attaching the silencer according to the first embodiment of the present invention.
Figure 4B:
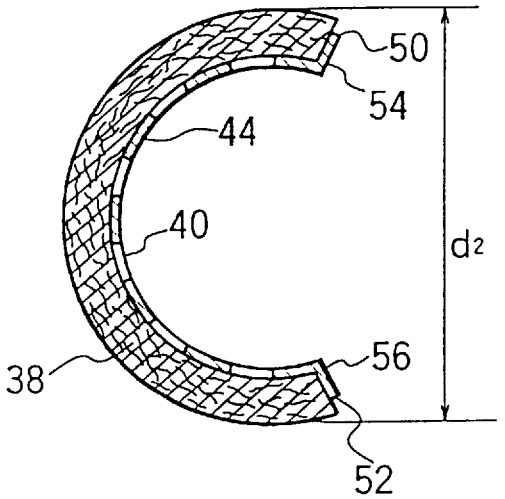

Now the silencer 37 which is mounted within the enlarged diameter portion 34 will be described with reference to FIGS. 2 to 4. The silencer 37 includes an inner pipe 42 in which many silencer holes 40 are provided, and the sound absorption material 38 which extends a certain length in the longitudinal direction of the inner pipe 42 and extends around the outer periphery of the inner pipe 42. The inner pipe 42, as shown clearly in FIGS. 3 and 4(*a*), includes a pair of thin plates 44 each of which is positioned longitudinally between an upstream step portion 34*a* and a downstream step portion 34*b* of the enlarged diameter portion 34. Each of the thin plates 44 includes collars 50,52 which extend along a pair of opposed edges 46,48, respectively, in order to have a generally square C-shaped cross section. One of the thin plates 44 is deformed into a convex configuration facing the direction in which the collars 50, 52 extend, and then introduced into an interior 27 of the blower pipe 26 in such a way that back surfaces 54, 56 of the collars 50, 52 of the deformed thin plate 44 abut against corresponding back surfaces 54, 56 of the collars 50, 52 of the other thin plate 44. As shown in FIG. 4(*a*), a stress-free length L of each of the thin plates 44 is greater than an inner diameter d of the blower pipe 26, so that neither of the thin plates 44 can be introduced into the interior 27 of the blower pipe 26 as it is, before being deformed.

Each of the thin plates 44 is made of flexible material, for example, synthetic resin such as polyethylene and other material which has an appropriate resiliency. In this connection, each of the thin plates 44 may have a cross section which is bent substantially uniformly in a longitudinal direction thereof.

On the other hand, the sound absorption material 38 is made of, for example, urethane foam so that its configuration can be deformed to permit it to be fitted along the outer periphery of the inner pipe 42. The longitudinal length or the thickness of the sound absorption material 38 can be suitably selected in accordance with the flow of the air stream, a pitch of the silencer holes 40, a diameter of the holes, etc.

The method of attaching the silencer 37, which comprises the above configuration, to the power blower 10 will now be explained below with reference to FIG. 4.

Firstly, as shown in FIG. 4(*a*), the sound absorption material 38 is retained by opposed inner surfaces 58, 60 of the collars 50,52 before the silencer 37 is inserted into the blower pipe 26.

Then, as shown in FIG. 4(*b*), the configuration of each of the flexible thin plates 44 is deformed, as otherwise it could not be inserted into the blower pipe 26, in such a way that its diameter becomes $d_2$, which is smaller than the inner diameter d of the opening 31, to be insertable into the opening 31. More specifically, each of the thin plates 44 is introduced into the blower pipe 26 through the opening 31, while it is gradually deformed along the inner surface of the blower pipe 26, whereby the inner pipe 42 is formed.

Then, by utilizing a restoring force generated by a resilient deformation of each of the thin plates 44, the sound absorption material 38 is fitted into the annular cavity 36 formed inside the enlarged diameter portion 34, while at the same time the sound absorption material 38 is pressed against the inner surface of the blower pipe 26 to be attached to the blower pipe 26.

One of the thin plates 44, which is to be attached to the blower pipe 26 after the other thin plate 26 is attached, can be much more easily attached by abutting its back surfaces 54,56 of its collars 50,52 against the corresponding back surfaces 54,56 of the collars 50, 52 of the other thin plates 44, which has already been attached.

As described above, the attachment of the pair of thin plates 44 to the blower pipe 26 enables the inner pipe 42, an inner diameter $d_1$ of which is slightly larger than the inner diameter d of the blower pipe 26, to be formed.

Thus the attachment of the silencer 37 to the blower pipe 26 is completed.

In this connection, the sound absorption material 38 may be fitted into the annular cavity 36 in advance, instead of being attached to each of the thin plates 44.

Then, the blower pipe 26 is connected to the air spout tube portion 24 of the main body 12 via the L-shaped groove 30, while its downstream end opening 31 is connected to the blower pipe 28 with the blow off spout 32.

Second Embodiment (FIG. 1 and FIGS. 5 to 7)

In this embodiment, descriptions of the elements which are the same as those in the first embodiment are omitted, such elements being given the same reference numbers as those in the first embodiment. Now the technical features of this second embodiment will be explained.

Figure 5:
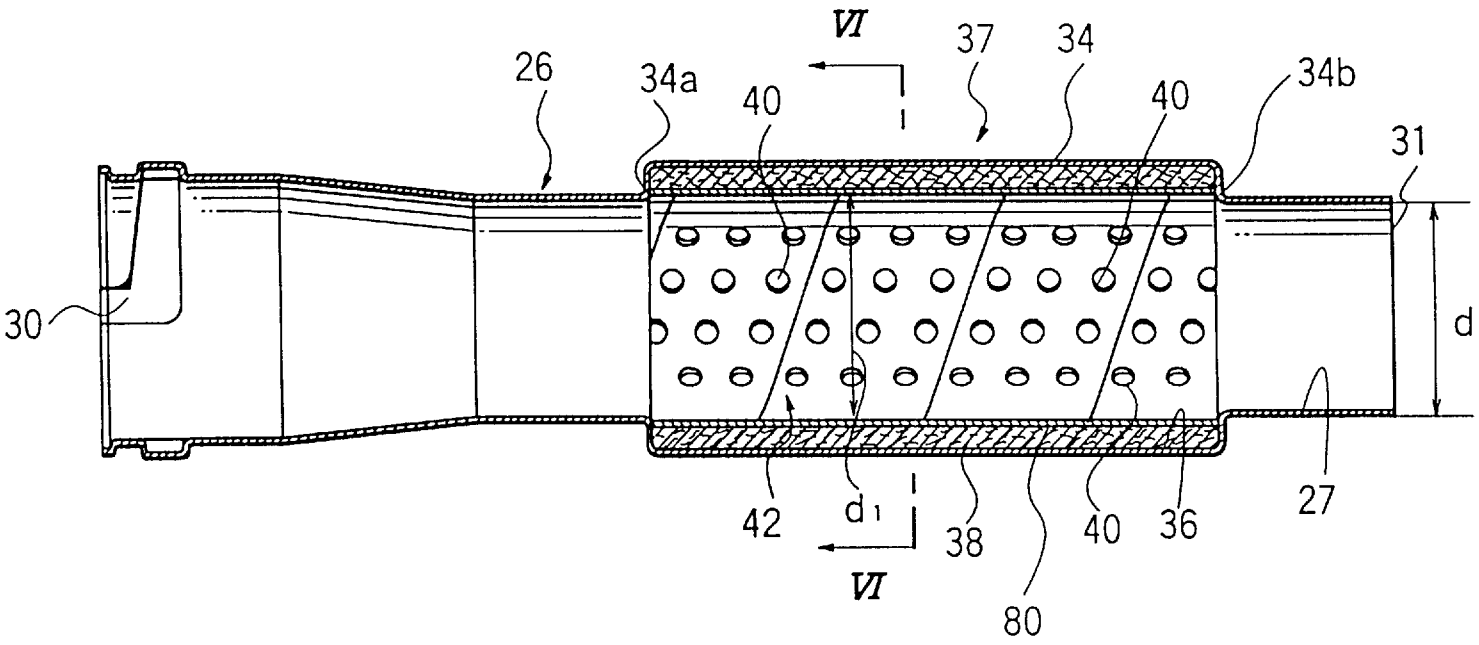
FIG. 5 is a diagrammatic longitudinal sectional view of a portion of the blower pipe according to the second embodiment of the present invention.
Figure 6:
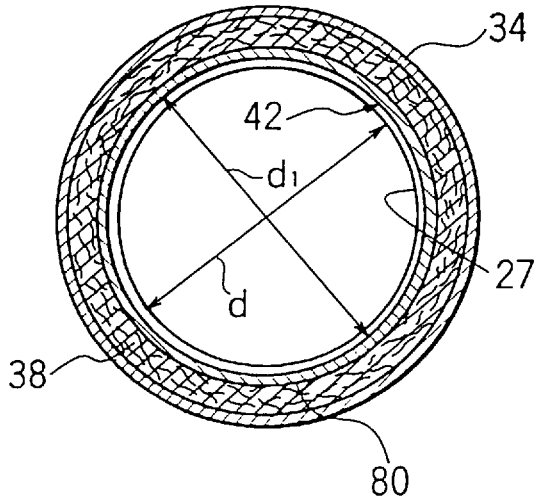
FIG. 6 is a cross sectional view taken along a line VI—VI of the FIG. 5.
Figure 7A:
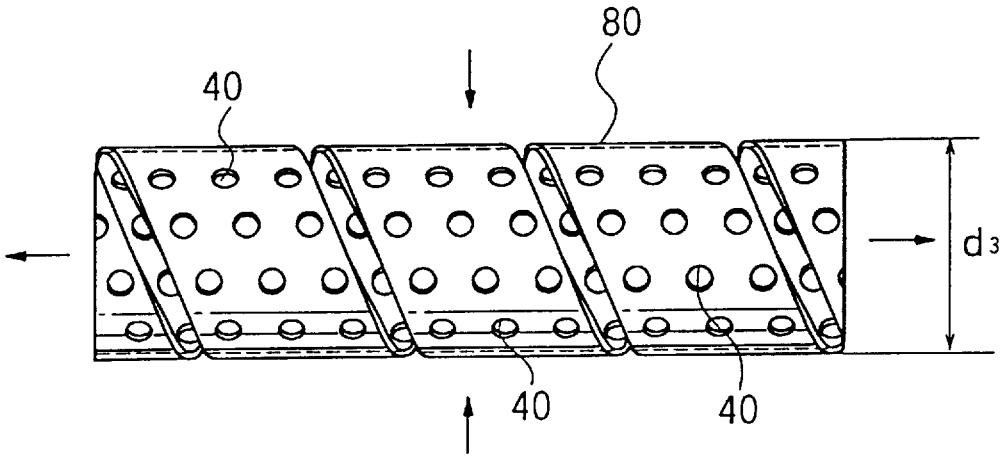
FIGS. 7(*a*) and 7(*b*) are side views of the silencer before and after its deformation, respectively, showing the method of attaching the silencer according to the second embodiment of the present invention.
Figure 7B:
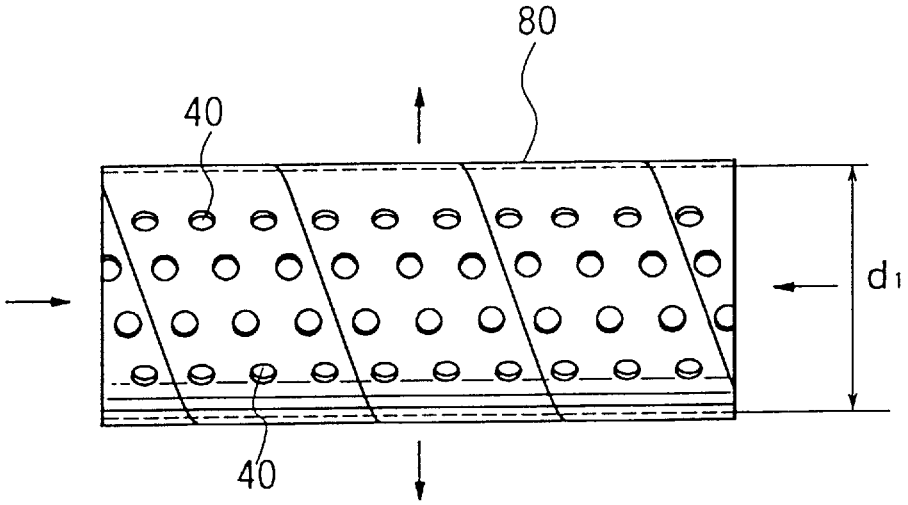

As shown in FIGS. 5 and 6, the inner pipe 42 is formed by helically rolling a strip member 80, which is made of a flexible material having an appropriate resiliency, such as polypropylene. As shown in FIGS. 7(*a*) and 7(*b*), when the inner pipe 42 is attached to the blower pipe 26, the inner pipe 42 is pulled in the longitudinal direction thereof to be deformed in such a way that an outer diameter of the inner pipe 42 is contracted to a diameter $d_3$ (See FIG. 7(*a*)) which is smaller than the inner diameter d of the blower pipe 26, and then the inner pipe 42 is inserted into the interior of the blower pipe 26 (See FIG. 7(*a*)). Then, the removal of the force pulling the inner pipe 42 within the enlarged diameter portion 34 of the blower pipe 26 causes the diameter of the inner pipe 42 to be returned to its original inner diameter $d_1$ (See FIG. 7(*b*)), which is slightly larger than the inner diameter d of the blower pipe 26, thereby causing the sound absorption material 38 to be pressed against the inner surface of the blower pipe 26, while at the same time the inner pipe 42 itself is fixedly attached to the sound absorption material 38 (See FIG. 7(*b*)).

In this connection, with regard to either of the above-described embodiments, when the sound absorption material 38 is to be serviced or replaced due to the wear thereof, the inner pipe 42 and the sound absorption material 38 can be easily removed by a procedure opposite to that for attaching them.

The present invention is not restricted to the above-described embodiments, and many variations may be made in design without deviating from the principal of the present claimed invention. For instance, a plurality of thin plates, which constitute the inner pipe 42, may be selectively adopted, instead of a pair of thin plates. In addition, the respective circumferential lengths of the thin plates 44 do not have to be equal to each other. Also, the enlarged diameter portion within which the silencer is mounted is not neccesarily indispensable, so long as an appropriate method for mounting the silencer can be adopted.

As is apparent from the above description, the method of forming and attaching the silencer to the blower pipe according to the present invention enables the silencer to be easily and handily attached to the blower pipe without having to use the fittings such as rivets, bolts, etc.

What is claimed is:

1. A silencer for use in an interior of a blower pipe though which a high-speed air stream passes, the silencer comprising:

an inner pipe, inserted into the interior of the blower pipe, the inner pipe including a flexible member that has a stress-free length preventing it from being inserted into the interior of the blower pipe without first being deformed, but which attaches the silencer to the interior of the blower pipe by a resilient restoring force that is caused by a resilient deformation that allowed the inner pipe to be inserted into the interior of the blower pipe, the inner pipe having plural holes; and a sound absorption material extending longitudinally around an outer periphery of the inner pipe.

2. The silencer of claim 1, wherein:

the sound absorption material fits into an annular cavity formed between an enlarged-diameter portion of the blower pipe and the inner pipe of the silencer.

3. The silencer of claim 1, wherein:

the flexible member is a thin plate that is deformed within an inner surface of the blower pipe.

4. The silencer of claim 3, wherein:

the thin plate has opposing edges with respective collars that retain the sound absorption material before the thin plate is introduced into the blower pipe.

5. The silencer of claim 3, wherein:

the thin plate is deformed to have a cross section that is bent substantially uniformly along its longitudinal direction.

6. The silencer of claim 1, wherein the inner pipe includes:

first and second thin plates having respective sets of collars at edges thereof, the thin plates being resiliently deformed into a convex configuration in the blower pipe so that collars of the first thin plate abut against corresponding collars of the second thin plate.

7. The silencer of claim 1, wherein:

the flexible member includes a helically-formed flexible strip introduced into the interior of the blower pipe by being pulled in its longitudinal direction to reduce its diameter.

8. A method of forming and attaching a silencer to a blower pipe, in which the silencer has an inner pipe with plural silencer holes and a sound absorption material extending longitudinally around its outer periphery, and in which the blower pipe is adapted to be connected to a blower so that a high-speed air stream passes through an interior of the inner pipe, the method comprising:

forming the inner pipe by resilient deformation of a flexible member that has a stress-free length preventing it from being inserted into an interior of the blower pipe without first being deformed;

introducing the resiliently-deformed flexible member into the interior of the blower pipe; and attaching the silencer to the blower pipe using a resilient restoring force caused by the resilient deformation.

9. The method of claim 8, wherein the blower pipe has a longitudinally-extending enlarged-diameter portion forming an annular cavity between the enlarged-diameter portion and the inner pipe of the silencer, and wherein the method includes:

fitting the sound absorption material into the annular cavity.

10. The method of claim 9, wherein the flexible member is a thin plate and the step of forming the inner pipe includes:

gradually deforming the thin plate along an inner surface of the enlarged-diameter portion while introducing the thin plate into the blower pipe.

11. The method of claim 10, wherein the thin plate has opposing edges with respective collars having respective inner surfaces that retain the sound absorption material before the thin plate is introduced into the blower pipe.

12. The method of claim 11, wherein the inner pipe includes first and second thin plates having respective sets of collars, and the forming and introducing steps include:

resiliently deforming the first and second thin plates into a convex configuration; and introducing the resiliently-deformed first and second thin plates into the blower pipe so that back surfaces of the collars of the first thin plate abut against corresponding back surfaces of the collars the second thin plate.

13. The method of claim 12, wherein the deforming step includes:

deforming the thin plate to have a cross section that is bent substantially uniformly in its longitudinal direction.

14. The method of claim 10, wherein the deforming step includes:

deforming the thin plate to have a cross section that is bent substantially uniformly in its longitudinal direction.

15. The method of claim 11, wherein the deforming step includes:

deforming the thin plate to have a cross section that is bent substantially uniformly in its longitudinal direction.

16. The method of claim 8, wherein the flexible member includes a helically-formed flexible strip, and the introducing step includes:

pulling the helically-formed flexible strip in its longitudinal direction to reduce its diameter while introducing it into the interior of the blower pipe.

* * * * *